United States Patent [19]

Bouvet

[11] Patent Number: 4,546,698

[45] Date of Patent: Oct. 15, 1985

[54] MILL ROLL WITH INCREASED JUICE FLOW CAPACITY

[76] Inventor: Jean Bouvet, 1319 Butterfield Rd., San Anselmo, Calif. 94960

[21] Appl. No.: 530,515

[22] Filed: Sep. 9, 1983

[51] Int. Cl.[4] ..... B21B 27/02

[52] U.S. Cl. ..... 100/121; 29/121.4; 99/509

[58] Field of Search ..... 99/485, 495, 496, 509, 99/510; 29/110, 121.1, 121.4, 121.6; 100/121, 97, 210

[56] References Cited

U.S. PATENT DOCUMENTS 3,969,802 7/1976 Bouvet ..... 100/121 X 3,974,554 8/1976 Fantuzzo ..... 29/121.4

4,192,050 3/1980 Appenzeller ..... 29/121.4 X

*Primary Examiner*—Timothy F. Simone

*Attorney, Agent, or Firm*—Melvin R. Stidham

[57] ABSTRACT

A mill roll for a juice extracting system having a plurality of circumferential grooves and a plurality of spiral flow passages extending from end to end below the surface of the roll. A plurality of holes around each circumferential groove open into the flow passages so that juice squeezed between the rolls flows through the holes and out the spiral passages. With the passages disposed spirally, the rolls may be used as the bottom roll in a three roll mill because juice squeezed between the top roll and a bottom roll and flowing into a channel will exit below the restraining flange normally provided on the top roll.

8 Claims, 2 Drawing Figures

MILL ROLL WITH INCREASED JUICE FLOW CAPACITY

BACKGROUND OF THE INVENTION

A conventional sugar cane mill includes a top roll and at least one bottom roll associated therewith so that a sugar cane blanket is milled between them to squeeze the juice from the blanket. A substantial amount of the juice squeezed from the cane tends to become trapped in the blanket and reabsorbed after the blanket passes between the top and bottom rolls. This led to the invention described and claimed in my prior U.S. Pat. No. 3,969,802 wherein at least one of the rolls is formed with a plurality of holes opening from circumferentially extending grooves into a plurality of axial channels within the body of the roll, so that juice squeezed from the cane blanket flows through the holes and then axially out through the channels. Mill rolls constructed in accordance with that invention have enjoyed considerable commercial success, but limitations on the number of holes and axial channels restrict the amount of juices that can be accommodated.

OBJECTS OF THE INVENTION

It is an object of this invention to provide a mill roll with perforations opening from the surface into lateral flow passages, all of increased flow capacity.

It is a further object of this invention to provide a mill roll having lateral flow passages of substantial flow area with considerable crushing structural strength.

Other objects and advantages of this invention will become apparent from the description to follow, particularly when read in conjunction with the accompanying drawings.

SUMMARY OF THE INVENTION

In carrying out this invention, I have modified the mill roll disclosed in my aforesaid prior U.S. Pat. No. 3,969,802 so that the lateral juice flow passages are disposed spirally, rather than axially, whereby the beam loading imposed by the cane blanket crushed between the rolls at the line of maximum compression between them is not taken along the full length of a channel as in the aforesaid patent. This enables the provision of wider or more numerous channels providing greater flow capacity, which in turn, can accommodate more radial holes opening from the surface of the roll into the circumferential grooves.

DESCRIPTION OF A PREFERRED EMBODIMENT

Figure 1:
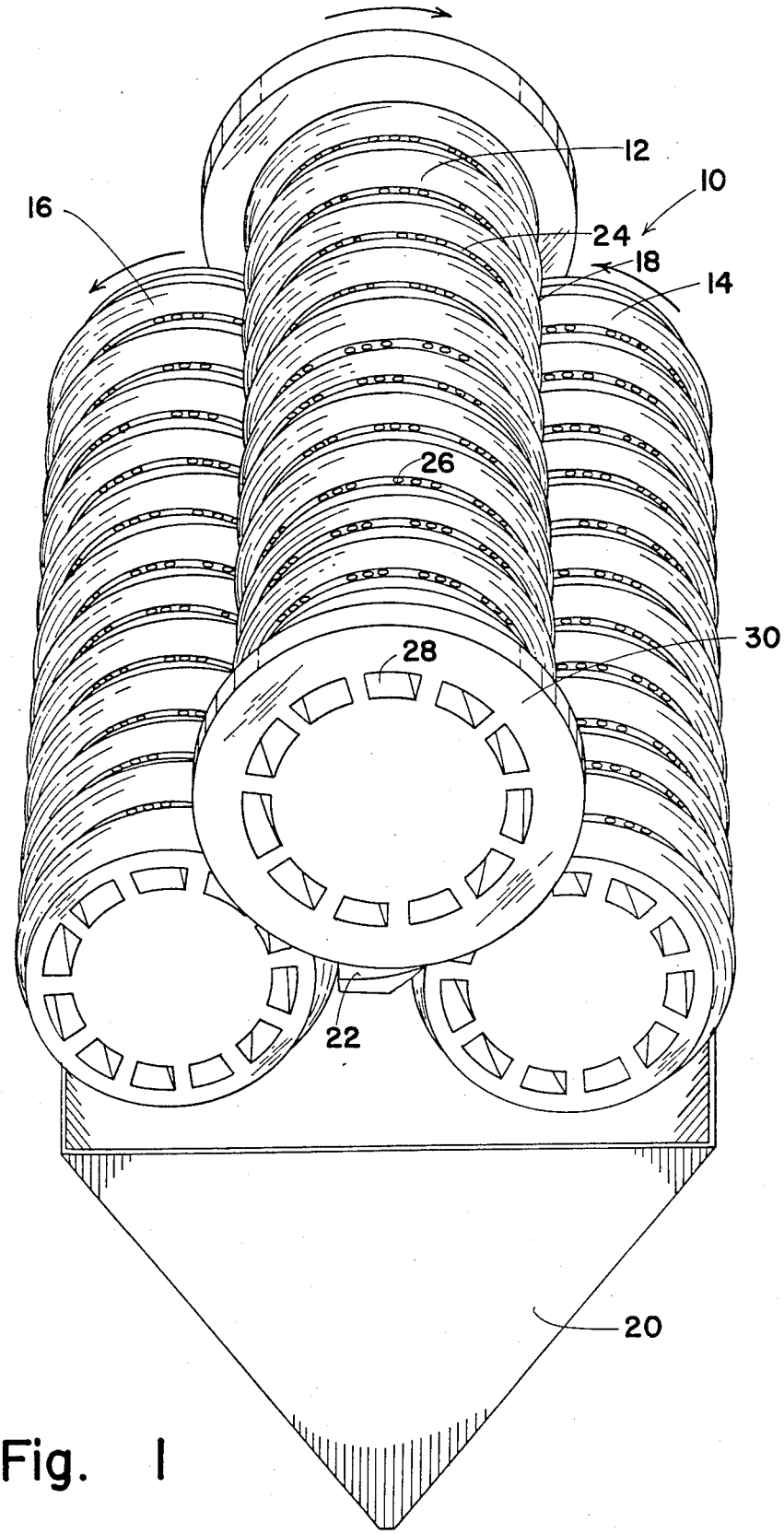
FIG. 1 is a top view in perspective of a three roll mill incorporating this invention.

Referring now to FIG. 1 with greater particularity, a typical sugar cane mill 10 may include a top roll 12 and two bottom rolls 14 and 16, which rotate as indicated by the arrows so that sugar cane or bagasse is fed into the mill at 18 to pass between the top roll 12 and right bottom roll 14, where the sugar cane blanket is crushed between them to squeeze juice out and into a suitable receptacle 20 for processing. The cane blanket then passes across a trash plate 22 to enter between the rolls 12 and 16 where additional juices are extracted.

In accordance with my prior invention, one or more of the rolls may be provided with a plurality of circumferential, Vee grooves 24 across the surface thereof and holes 26 at the bottoms of the grooves open into axial passageways 28 that extend the length of the roll so that additional juices squeezed from the cane blanket flow into the holes 26 and along the longitudinal passageways 28 to exit at the ends of the rolls, greatly increasing the extraction of juices from sugar cane, or liquids from pulp in any event.

Generally, one of the rolls, usually the top roll 12 in a three mill roll as shown, is provided with flanges 30 at the ends which extend over the ends of the bottom rolls 14 and 16 in the areas of maximum pulp compression to prevent extrusion of the bagasse from the sides of the mill 10. In some cases, stationary plates on the machine function as the flanges. Unfortunately, in whatever form, the flanges 30 also tend to block the ends of the longitudinal passageways to limit the capacity of the longitudinal juice ducts 28 when same are provided in the bottom rolls.

Figure 2:
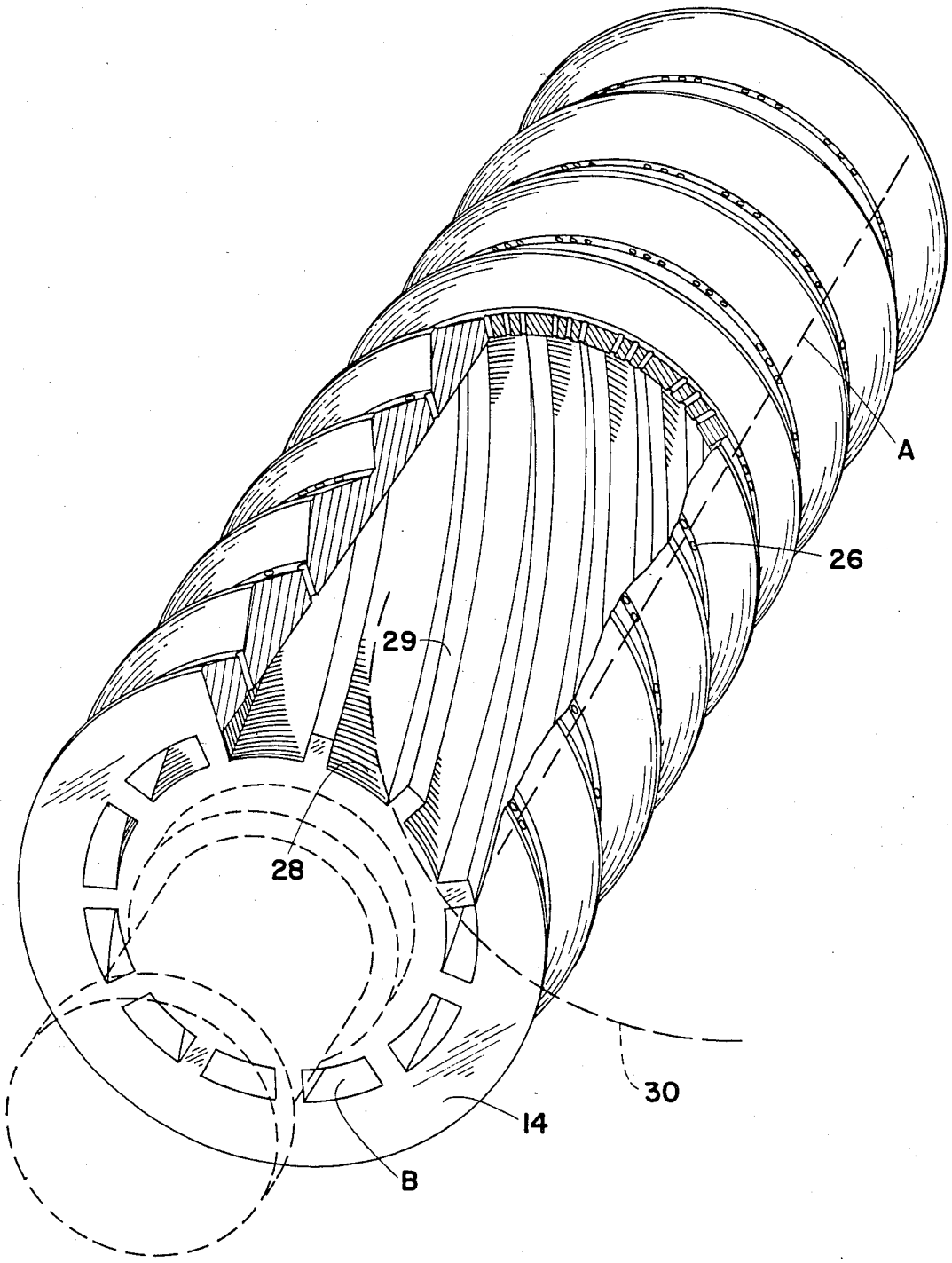
FIG. 2 is a view in perspective of a mill roll constructed in accordance with this invention.

As shown in FIG. 2, this disadvantage is overcome in the present invention by forming the end to end passageways 28 of spiral configuration. When the bagasse is being squeezed between the bottom roll 14 and the top roll 12 in the area of maximum compression along the dashed line A in FIG. 2, the juice that is squeezed into holes 26 at that level follows the spiral configuration of the flow passage to exit at approximately point B, well clear of the restraining flange of the upper roll 30. This spiral configuration of the passageways has been tested and found highly effective with passageways that curve from one end of the roll 14 to the other.

An additional advantage of the spiral configuration will become apparent from FIG. 2. As the roll passes through the line of maximum compression A the metal of the roll 14 radially outward of the passageways 28 is supported along its length by the columns of metal 29 between the passageways, so that there is a plurality of short columns along the length of the roll and no unsupported metal from end to end, as in the case of axially disposed flow passages. This minimizes the chances of fracture, and enables the application of higher compression pressures between rolls, as well as the provision of wider channels. Of course, wider channels 28 can accommodate a larger number of holes or perforations 26, further to increase flow capacity.

In the event a roll does become worn after extended use, it may be machined down to the tops of the spiral columns 29, and a sleeve with the circumferential Vee grooves 24 and perforations 26 secured in place over it.

While this invention has been described in conjunction with a preferred embodiment thereof, it is obvious that modifications and changes therein may be made by those skilled in the art to which it pertains, without departing from the spirit and scope of this invention as defined by the claims appended hereto.

What I claim as invention is:

1. A mill roll for a liquid extracting system comprising:

a generally cylindrical, rigid body;

a plurality of circumferential grooves around the outer surface of said body;

a plurality of juice flow channels within and around said body below said outer surface thereof and opening from at least one end thereof;

said channels being of spiral configuration extending end to end of said body through less than one turn about the axis thereof; and a plurality of generally radial holes in said body forming flow ducts between said grooves and said channels.

2. The mill roll defined by claim 1 wherein:

there are at least two holes in a groove opening into one of said channels.

3. The mill roll defined by claim 1 wherein:

there are at least two holes in a circumferential groove opening into each of said channels.

4. In a liquid extracting system comprising:

a generally cylindrical top roll;

at least one generally cylindrical bottom roll cooperatively associated with said top roll so that pulp is milled between said rolls;

a plurality of complementary circumferential grooves around the outer surfaces of said rolls;

a plurality of juice flow channels within and around one of said rolls below said outer surface thereof and opening from at least one end thereof;

a plurality of generally radial holes in said one forming flow ducts between said grooves and said channels; and restraining means adjacent to said one end of said one roll where it most closely approaches the other roll to prevent lateral extrusion of pulp;

said channels being disposed spirally, extending end to end of said one roll through less than one turn about the axis thereof, so that juice squeezed from pulp between said rolls flows from channels displaced from said restraining means.

5. The liquid extracting system defined by claim 4 wherein said restraining means comprises:

a flange on one end of said other roll embracing said one end of said one roll.

6. The liquid extracting system defined by claim 4 wherein:

there is one top roll and two bottom rolls;

said flow channels being disposed in at least one of said bottom rolls; and said restraining means comprising:

a flange on the end of said top roll embracing the end of said one bottom roll.

7. The liquid extracting system defined by claim 4 wherein said restraining means comprises:

a flange on the ends of said other roll embracing the ends of said one roll.

8. The liquid extracting system defined by claim 4 wherein:

there is one top roll and two bottom rolls;

said flow channels being disposed in at least one of said bottom rolls; and said restraining means comprising:

flanges on the ends of said top roll embracing the ends of said one bottom roll.

* * * * *